United States Patent [19]

Goble

[11] 4,060,956

[45] Dec. 6, 1977

[54] METHOD FOR FILLING A CONTAINER WITH A LIQUID SATURATED WITH A GAS AND SEALING WHILE AVOIDING FROTHING OF THE LIQUID

[75] Inventor: Ralph W. Goble, Eldora, Colo.

[73] Assignee: Bernard J. Meinerz, Evergreen, Colo. ; a part interest

[21] Appl. No.: 692,299

[22] Filed: June 3, 1976

[51] Int. Cl.[2] ..... B65B 31/02

[52] U.S. Cl. ..... 53/22 R; 53/86; 53/112 R; 141/5; 426/397

[58] Field of Search ..... 426/397, 399; 53/7, 53/22 R, 86, 90, 91, 92, 93, 94, 95, 96, 97, 112 R; 141/4, 5, 6

[56] References Cited

U.S. PATENT DOCUMENTS

| | | | |
|---|---|---|---|
| 2,016,384 | 10/1935 | Meyer | 141/5 X |
| 2,380,984 | 8/1945 | Moeller | 53/22 R |
| 3,477,192 | 11/1969 | Brown et al. | 53/7 X |
| 3,804,133 | 4/1974 | Copping | 53/7 X |

*Primary Examiner*—Travis S. McGehee
*Attorney, Agent, or Firm*—Max L. Wymore

[57] ABSTRACT

This invention is directed to a method and an apparatus for carrying out that method of transferring an unsealed container of a liquid containing dissolved gas from a filling station to a sealing station where a closure is applied while avoiding foaming and frothing of liquid from the container and the attendant loss of liquid by subjecting the container and contents during such transfer to an ambient super atmospheric pressure.

6 Claims, 3 Drawing Figures

METHOD FOR FILLING A CONTAINER WITH A LIQUID SATURATED WITH A GAS AND SEALING WHILE AVOIDING FROTHING OF THE LIQUID

BACKGROUND OF THE INVENTION

At present, liquids containing a dissolved gas, such as soft drinks, beer and the like, when bottled or canned, in passing from the filling station to the sealing station, lose a substantial amount of liquid due to the frothing and foaming that occur inherently and that induced by the shaking and joggling of the container in being moved from the filler to the capper or sealer. In one brewery alone, it is estimated that in excess of 4 million barrels of beer are lost in the time of one year by frothing and foaming of the beer in being conveyed from the filling operation to the sealing station. At roughly forty dollars per barrel, this represents a substantial loss of profit.

SUMMARY OF THE INVENTION

As herein described, the present invention comprises a method and apparatus for substantially eliminating foaming and frothing of a gas containing liquid introduced into a container at a filling station and transported to a sealing station for the sealing thereof by a closure wherein the method includes enclosing the filling, transporting and sealing operations within an enclosure within which a super atmospheric pressure of life support gases is established and maintained.

BRIEF DESCRIPTION OF THE DRAWINGS

The foregoing features and advantages of the invention will become more apparent from the detailed description hereinafter considered in conjunction with the accompanying drawings wherein.

Figure 1:
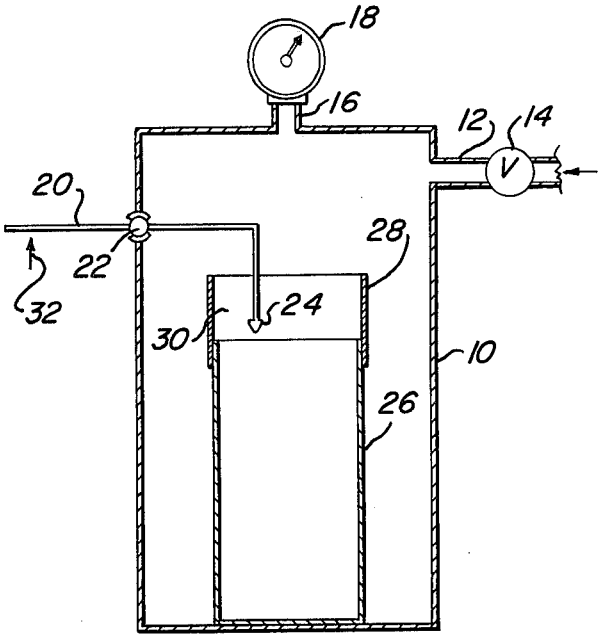
FIG. 1 is a diagrammatic illustration of the test apparatus used to verify the operation of the method of the present invention.

Referring now to the drawings and in particular to FIG. 1, there is diagrammatically illustrated a test jig which comprises an enclosure 10 having an inlet conduit 12 therein closed by means of a valve 14. Enclosure is also provided with an outlet 16 to which is attached a pressure gauge 18. One wall of the enclosure 10 has a finger 20 movably mounted therein for pivotal movement at 22 with the finger having an end 24 within the enclosure adapted to pierce or otherwise open a can 26 positioned within the enclosure 10. The can is provided with an upstanding collar 28 around the top thereof in liquid tight relation with the can to provide a liquid reservoir 30. Can 26 is a filled and sealed can of carbonated liquid that is shaken and placed inside the enclosure 10. Finger 20 is actuated in the direction of arrow 32 causing end 24 to either pierce the can 26 and open same or open a closure means. Gas and liquid escape from the can with foam and froth filling the reservoir 30. Air under pressure is introduced into the enclosure via inlet 12, valve 14 being opened. Air under pressure is contained to be introduced and the pressure within the enclosure is increased until the liquid and foam that has escaped the can on being opened has returned to the can. At this point the pressure within the enclosure is noted and found to be about 5 psi gauge. Next, another can containing a carbonated liquid was shaken and placed in the enclosure 10 and the can 26 is provided with a collar 28. Air under pressure was introduced into the enclosure until the gauge 18 showed a positive pressure of about 5 pounds psi. The finger 20 was then actuated to open the can and no foaming or frothing was in evidence and no liquid escaped from the can into chamber 30. Thus, it was discovered that if a can of carbonated beverage such as soft drinks or beer are opened while an ambient atmospheric pressure of about 5 pounds psi or more is maintained thereon, the liquid is quiescent and no foaming or frothing occurs.

Figure 3:
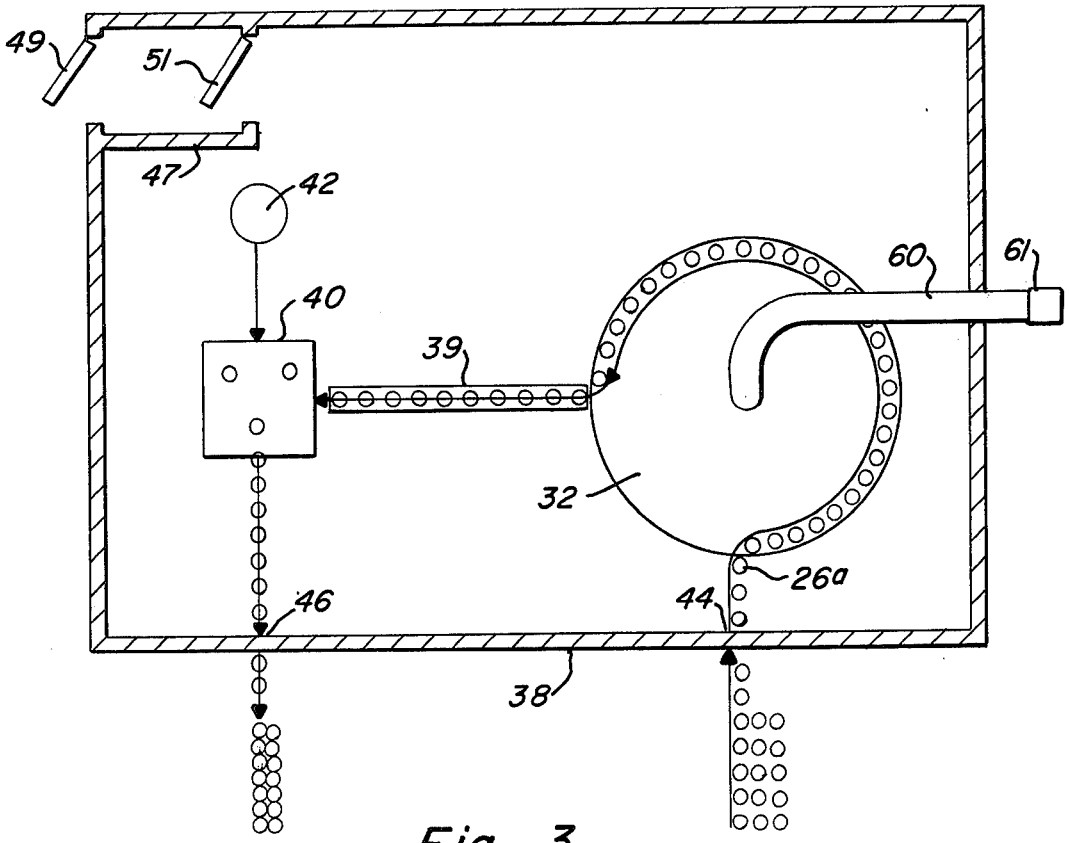

Considerable foaming and frothing of liquids containing dissolved gases, such as carbonated soft drinks and beer, is experienced when these liquids are canned or bottled. In the case of cans, the empty cans are introduced onto a carousel 34, FIG. 3, where the open top cans 26a are positioned beneath a filler arrangement 36. The carousel 34 is positioned within a pressurized compartment 38 which has a positive air pressure of at least about 5 psi gauge. Also enclosed within compartment 38 is a transfer means 39 and a sealer 40 for receiving lids 42 and sealing same to the filled cans. The empty cans are either stored within the pressurized compartment 38 or introduced thereinto through an air-lock entry as at 44 while the filled and sealed cans are either stored within compartment 38 or removed therefrom through an exit air-lock as at 46. Compartment 38 is also provided with a suitable air-lock means 47 having doors 49 and 51 to permit operators to gain ready access to the compartment without loss of the pressure within the compartment.

Figure 2:
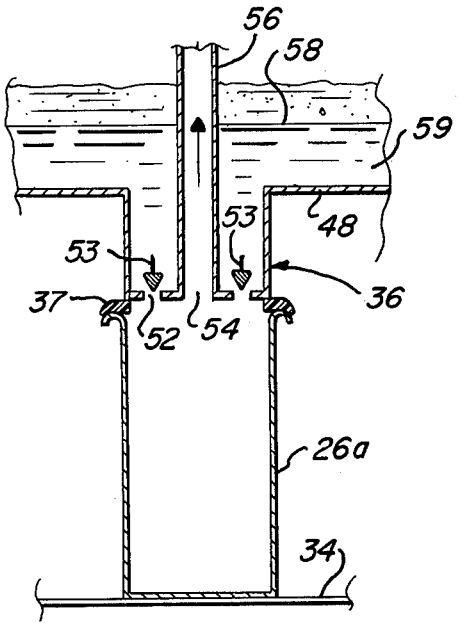
FIG. 2 is an elevational sectional view of a portion of the filling station for filling cans with a liquid saturated with gas; and, FIG. 3 is a plan view of an enclosure containing a container filling station, a filled container conveyor and a sealing station within the enclosure which is maintained at a super atmospheric pressure.

Referring now to FIG. 2, the filler 36 is adapted to fit onto and overlap the top of an empty can 26a in sealed relation with a seal 37. The filler is connected to a reservoir 48 having a liquid 50 thereinto be transferred from the reservoir to the can 26a. The interior of the reservoir 48 is sealed from the interior of the compartment 38 and is maintained at a super atmospheric pressure of from about 5 psi to about 20 psi gauge. The filler 36 is provided with a plurality of valved openings 52 opened and closed by valves 53 through which the liquid passes when the valves are opened from the reservoir 48 to can 26a since the pressure in the cans prior to filling is essentially atmospheric or about 0 psi gauge. The filler is also provided with a central vent opening 54 to which is connected a vent conduit 56 of a length to pass up through the liquid level 58 of the liquid 59 within the reservoir to a point exterior of the compartment 38, such that when the liquid is dispensed by gravity into the can, when the valve openings 52 are opened, the incoming liquid forces the air out of the can through the vent conduit 56 to a point exterior of the reservoir 32. The interior of the reservoir 48 is vented through the conduit 56 to the atmosphere via a poppet valve 60 set to release when the predetermined pressure in the reservoir to which the valve 60 is set is exceeded. It should be noted that the liquid 59 is covered by a blanket of heavier than air gas, such as $CO_2$, in the case of a carbonated liquid system.

As the filled cans exit the carousel, the liquid therein is at super atmospheric pressure, normally, as soon as the cans leave the filling operation they are subjected to an ambient atmospheric pressure resulting in foaming and frothing. According to the present invention the cans leaving the filling station are subjected to a pressure of at least about 5 psi above atmospheric. This above atmospheric pressure is continued to be applied to the filled cans during the transporting thereof along conveyor 38 and into the sealer 40 such that when lids 42 are inserted into the top of each can and sealed, the contents of the cans and the cans, are subjected to a super atmospheric pressure of at least 5 psi. After the cans are sealed, they then exit the pressurized compartment 38 via an air-lock as at 46.

It appears to be critical that the air pressure within compartment 38 be maintained at a pressure that is in excess of the nucleation pressure of the liquid-gas system involved. In the case of a carbon dioxide gas-water system, the nucleation pressure of the $CO_2$ gas bubbles is found to be 5 psi at approximately an altitude of 5280 feet above sea level and would vary slightly at other altitudes. A pressure in excess of nucleation pressure is defined as that pressure just sufficient when maintained over a liquid saturated with a gas to avoid ready gas bubble nucleation.

Thus, it is seen that the objects and advantages have been accomplished by the disclosed invention. While I have shown and described a preferred embodiment of the invention, it will be readily apparent to those skilled in the art that there are a multitude of changes, improvements and modifications which may be made therein without departing from the spirit and scope thereof.

What is claimed is:

1. A method of preventing foaming and frothing of a liquid containing a gas during the introduction into and sealing of a container therefor which comprises providing a pressure tight compartment, filling a container with a liquid containing a gas at a super atmospheric pressure sufficient to substantially prevent gas bubble nucleation at a filling station within said compartment, establishing and maintaining an ambient super atmospheric pressure in the compartment substantially as great as the gas pressure in the liquid, removing the filled container from the filling station in the presence of the ambient super atmospheric pressure in the compartment which acts to substantially prevent gas bubble nucleation in the liquid, transporting the filled container from the filling station to a sealing station while maintaining the super atmospheric pressure on the liquid contents, applying a closure to the container and sealing and closing the container while under said super atmospheric pressure.

2. The method according to claim 1 wherein the super atmospheric pressure maintained is at least 5 psi gauge.

3. The method of claim 2 wherein the super atmospheric pressure is maintained at from about 5 psi to about 20 psi gauge.

4. The method of claim 2 wherein the super atmosphere is of life supporting gases.

5. The method of claim 3 wherein the super atmosphere is of air.

6. The method of claim 5 wherein the pressure tight compartment includes air lock means to permit ingress and egress of persons within said compartment without loss of pressure within the compartment.

* * * * *